US009604709B2

(12) United States Patent
Barnes et al.

(10) Patent No.: US 9,604,709 B2
(45) Date of Patent: Mar. 28, 2017

(54) BOAT LIFT

(71) Applicants: Sean A. Barnes, Mt. Pleasant, SC (US); Michael W. Kirby, Mt. Pleasant, SC (US)

(72) Inventors: Sean A. Barnes, Mt. Pleasant, SC (US); Michael W. Kirby, Mt. Pleasant, SC (US)

( * ) Notice: Subject to any disclaimer, the term of this patent is extended or adjusted under 35 U.S.C. 154(b) by 0 days.

(21) Appl. No.: 15/160,372

(22) Filed: May 20, 2016

(65) Prior Publication Data

US 2016/0264221 A1 Sep. 15, 2016

Related U.S. Application Data

(63) Continuation-in-part of application No. 14/676,311, filed on Apr. 1, 2015, now Pat. No. 9,352,812, which is a continuation of application No. 14/077,854, filed on Nov. 12, 2013, now Pat. No. 9,132,897.

(60) Provisional application No. 61/725,506, filed on Nov. 13, 2012.

(51) Int. Cl.

| | |
|---|---|
| ***B63C 1/06*** | (2006.01) |
| ***B63B 43/04*** | (2006.01) |
| ***B63C 1/02*** | (2006.01) |
| *B63B 35/34* | (2006.01) |

(52) U.S. Cl.

CPC ..... *B63C 1/06* (2013.01); *B63B 43/04* (2013.01); *B63C 1/02* (2013.01); *B63B 35/34* (2013.01); *B63B 2241/10* (2013.01)

(58) Field of Classification Search

CPC ..... B63C 1/00; B63C 1/02; B63C 1/06

See application file for complete search history.

(56) References Cited

U.S. PATENT DOCUMENTS

| | | | | |
|---|---|---|---|---|
| 3,270,698 A | | 9/1966 | Fort | |
| RE27,090 E | | 3/1971 | Rutter | |
| 3,603,276 A | | 9/1971 | De Lisle | |
| 3,727,415 A | | 4/1973 | Williams | |
| 3,895,592 A | * | 7/1975 | King | B63C 1/02 114/45 |
| 3,967,570 A | | 7/1976 | Bradfield | |
| 3,991,695 A | * | 11/1976 | McDonald | B63C 1/06 114/45 |
| 4,018,179 A | | 4/1977 | Rutter | |
| 4,072,119 A | | 2/1978 | Williams | |
| 4,276,849 A | | 7/1981 | Bloxham | |

(Continued)

FOREIGN PATENT DOCUMENTS

| | | | |
|---|---|---|---|
| FR | 3017595 | * | 8/2015 |
| WO | WO2014035026 | | 3/2014 |

*Primary Examiner* — Frederick L Lagman

(74) *Attorney, Agent, or Firm* — B. Craig Killough; Barnwell Whaley Patterson & Helms

(57) ABSTRACT

A floating boat lift having flotation tanks positioned under sides of a frame of the boat lift. Water flow is regulated so that tanks fill from near the center of the boat lift. A preferred hingeable connection of the boat lift to a bulkhead, along with lateral stabilization, participates in maintaining a generally horizontal attitude for the boat lift. Water is accepted into or pumped from the flotation tanks, allowing the frame of the boat lift to fall or rise relative to the surface of the water. One or more catwalks along the sides of the boat lift and connected to the bulkhead may float, but at a level that is independent of the boat lift frame.

15 Claims, 16 Drawing Sheets

(56) References Cited

U.S. PATENT DOCUMENTS 4,280,429 A * 7/1981 Wells ..... B63C 1/06 114/125
4,510,877 A 4/1985 Bloxham
4,641,595 A 2/1987 Pritchett
4,763,592 A 8/1988 Russ
4,782,778 A 11/1988 Barbaglia
5,002,000 A 3/1991 Rutter
5,016,551 A 5/1991 Peck et al.
5,140,922 A 8/1992 Bowman et al.
5,394,814 A 3/1995 Rutter et al.
5,549,070 A 8/1996 Cruchelow et al.
5,664,513 A 9/1997 Echelbarger
5,826,528 A 10/1998 Jancsek
5,860,765 A 1/1999 Cruchelow et al.
6,131,528 A * 10/2000 Meek ..... B63C 1/02 114/44
6,477,968 B2 11/2002 Powell
6,526,902 B1 3/2003 Faber
6,547,485 B2 4/2003 Elson
8,267,621 B1 9/2012 Way
9,132,897 B2 9/2015 Barnes et al.
9,266,590 B1 * 2/2016 Dye ..... B63C 1/02
9,352,812 B1 * 5/2016 Barnes ..... B63B 43/04
2001/0015163 A1 * 8/2001 Powell ..... B63C 1/04 114/46
2002/0131821 A1 9/2002 Elson
2005/0013663 A1 * 1/2005 Basta ..... B63C 3/00 405/3
2006/0156964 A1 * 7/2006 Canniffe ..... B63C 3/12 114/49
2008/0306642 A1 12/2008 Figura et al.
2009/0235857 A1 * 9/2009 Hodapp ..... B63B 17/00 114/343
2011/0146554 A1 6/2011 Wright et al.
2011/0277675 A1 11/2011 Thom et al.
2014/0010593 A1 1/2014 Davis

* cited by examiner

BOAT LIFT

This Application a continuation in part of U.S. application Ser. No. 14/676,311, filed Apr. 1, 2015, U.S. Pat. No. 9,352,812, which is a continuation of U.S. application Ser. No. 14/077,854, filed Nov. 12, 2013, U.S. Pat. No. 9,132,897, which claimed the benefit of U.S. Provisional Application No. 61/725,506 filed Nov. 13, 2012, the benefit of which is claimed hereby.

FIELD OF THE INVENTION

This invention relates to docks for boats and vessels generally, and is more specifically related to a boat lift.

BACKGROUND OF THE INVENTION

It is desirable to store boats out of the water when not in use. Particularly in salt water environments, water can lead to rapid corrosion of metal parts, and depreciation of other parts of the boat. Further, in many salt water environments, storage of the boat hull in the water leads to fouling of the hull, propellers and through hulls that communicate with boat utilities. Barnacle growth, for example, occurs in many salt water environments, and such fouling reduces performance of the boat hull and propulsion systems.

In one particular example, barnacles and other growth attributed to storing a boat hull in water occurs in through hulls and other openings in the hull. For example, barnacle growth in water inlets for jet boats that use water for propulsion or for boats that pumps water, such as firefighting vessels, experience fouling in the water intakes. While fouling on a boat hull is undesirable, fouling of water inlets or engine cooling could result in engine failures, and fouling in water inlets of vessels for emergency response can also be disastrous. It is expensive to frequently inspect and remove growth, such as barnacle growth, but is critical to do so if the boat is stored in water.

There is a need for a drive on boat lift that is reliable, and provides rapid, high lifting capacity, while also allowing the boat to be driven on to the boat lift at a generally horizontal attitude, so that the operator's vision is not obstructed by an elevated bow during the critical time while the boat is positioned at the dock.

SUMMARY OF THE INVENTION

The present invention is a floating boat lift having flotation tanks positioned under a frame of the boat lift. Flotation tanks fill from near the center of the boat lift. A preferred hingeable connection of the boat lift to a bulkhead, along with lateral stabilization, participates in maintaining a generally horizontal attitude for the boat lift. Water is accepted into or pumped from the plurality of flotation tanks, allowing the frame of the boat lift to fall or rise relative to the surface of the water. One or more catwalks along the sides of the boat lift and connected to the bulkhead may float at a level that is independent of the boat lift frame.

BRIEF DRAWING DESCRIPTION

DESCRIPTION OF PREFERRED EMBODIMENTS

Figure 6:
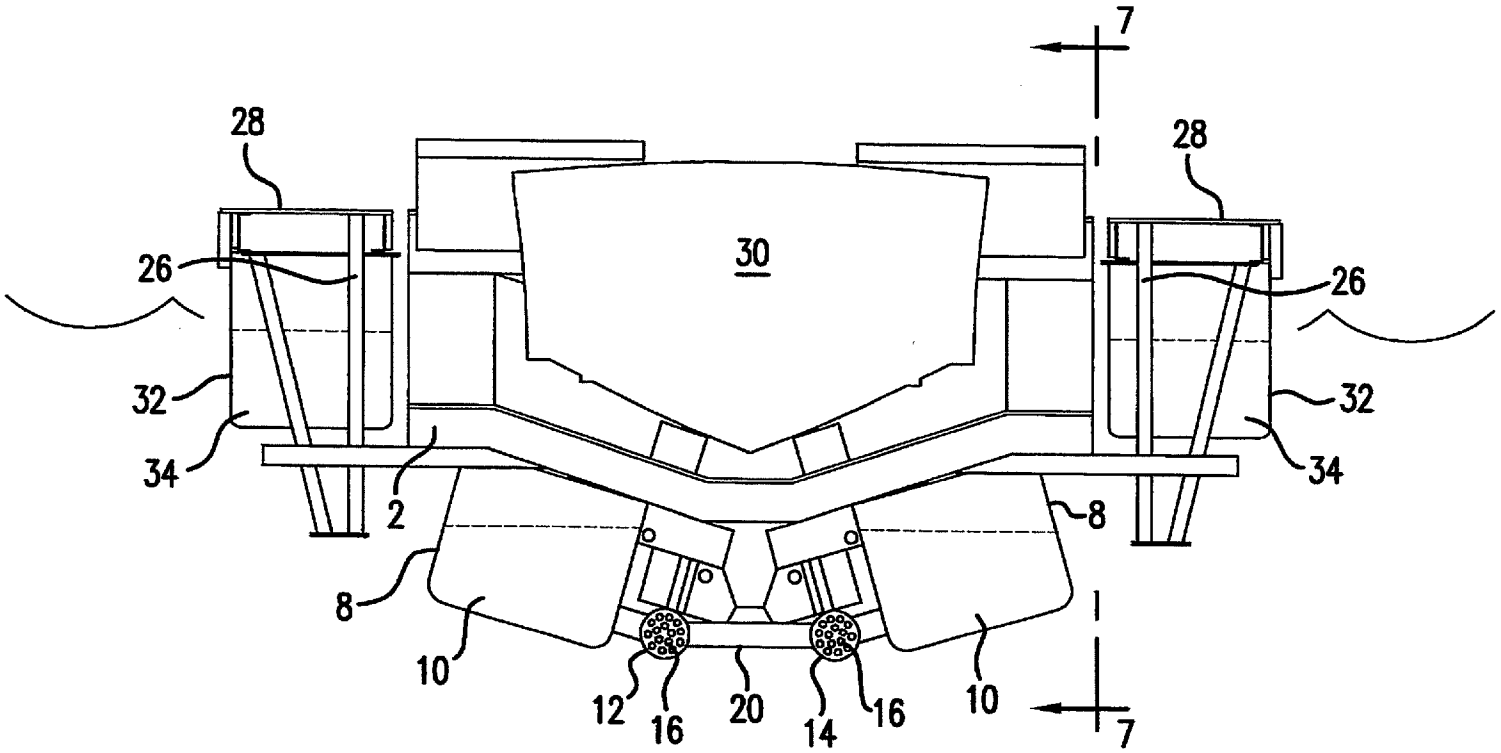
FIG. 6 is a rear elevation of the boat lift with a boat in position on the boat lift, and the boat lift in a relatively lowered position.

In preferred embodiments, a boat lift comprises a frame 2 or similar sub-structure. The frame may generally have a v-shape to accommodate the common shape for boat hulls, so that the frame is constructed and arranged to receive and hold a boat hull in a stable and generally horizontal position. FIG. 6. The frame may be covered with planking 4, which may be wood, and which may be teak, as demonstrated in the drawing figures. The frame may be covered with other materials, which may be synthetic rubber or other elastomers or polymers that will receive and hold the boat hull without damaging the boat hull other materials of which docks and boat lifts are formed of may be used.

A hinged frame section 6 of the boat lift connects the frame to a bulkhead, which may be floating. The hinged boat lift section is hingeably connected to the frame and hingeably connected to the floating bulkhead. The hinged boat lift section may be covered with the planking 4 or other material of which the frame of the boat lift is covered. The bulkhead is preferred to be floating in most cases. In addition, it may be a fixture in some manner to real estate.

Positioned underneath the boat lift frame is a plurality of flotation tanks 8. A first plurality of flotation tanks is positioned along one side of the boat lift frame, and a second plurality of tanks is positioned along a second side of the boat lift frame. The tanks are constructed and arranged to be flooded with water, and subsequently to have water evacuated from the tanks to cause submersion of the boat lift frame, and lifting of the boat lift.

Figure 8:
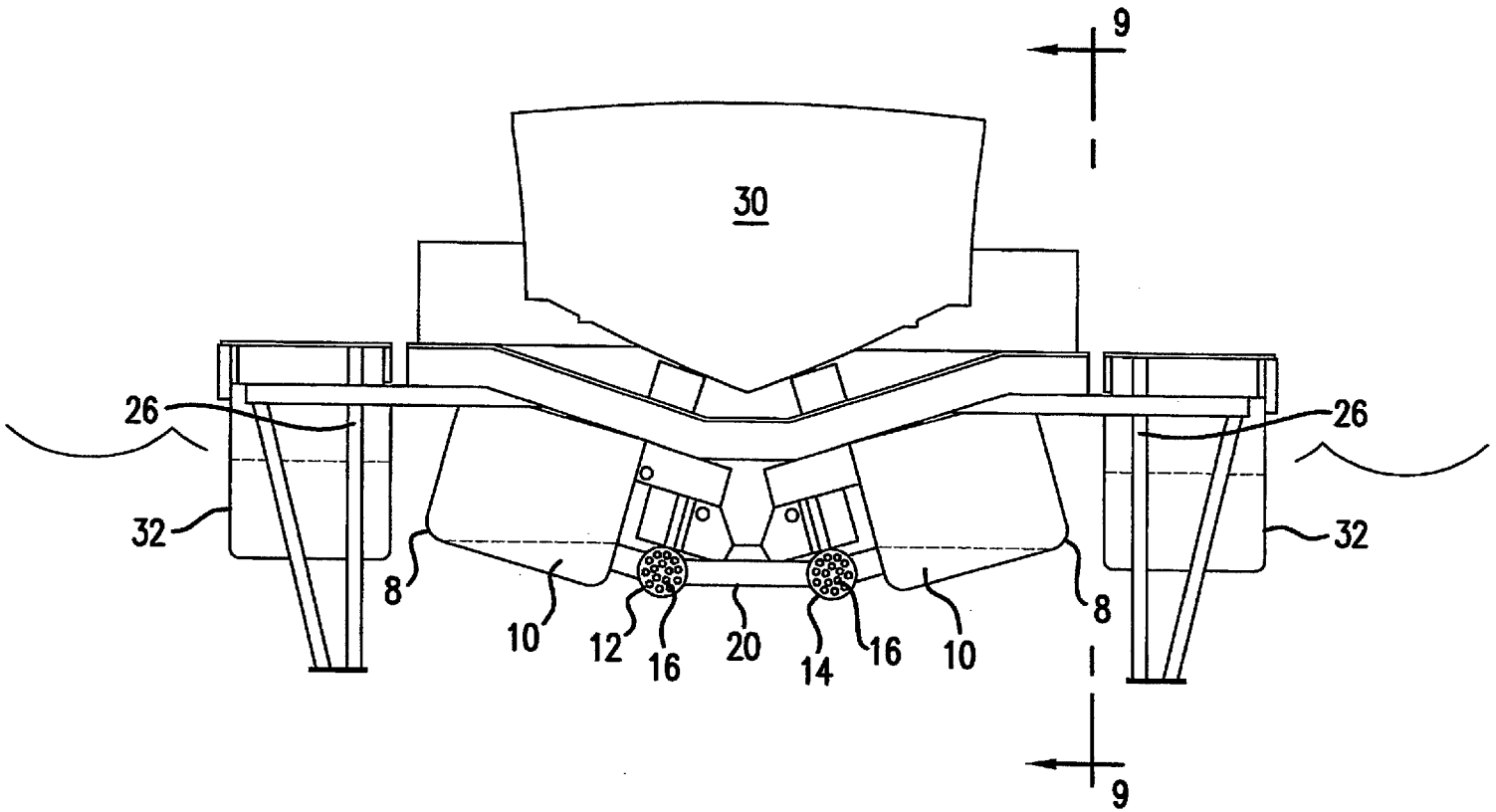
FIG. 8 is a rear elevation of the boat lift with a boat in position on the boat lift, and the boat lift in a raised, elevated position.

In a preferred embodiment, the flotation tanks are rectangular in cross-section, as shown in drawings. A rectangular cross section may include a square cross section. As shown in FIG. 6 and FIG. 8, the bottom of the flotation tanks is at an angle from horizontal. In a preferred embodiment, this angle will be between 10 and 45 degrees from horizontal. As shown particularly in FIG. 8, when the tanks are evacuated of water 10, the remaining water will settle in the lower most portion of the tank, and in a corner thereof due to the angle of the tank. Causing the remaining water to flow to the corner of the generally horizontal tank provides for the most evacuation of water, since the pick up for the conduit to the water pump may be located in this corner. If the tanks are mounted so that the bottom is substantially horizontal, evacuation of the water is not as complete. The rectangular cross section, in many cases, provides a flat top surface for mounting the tanks against the upwardly angled surface of the boat lift frame that is generally v-shaped in the preferred embodiment shown in FIGS. 6 and 8.

In a preferred embodiment, a first trunk line 12 and a second trunk line 14 are positioned between the first plurality of flotation tanks and second plurality of flotation tanks. The first trunk line and a second trunk line are generally parallel to each other, positioned horizontally, and run longitudinally underneath the boat lift frame and between the first plurality of flotation tanks and second plurality of flotation tanks and substantially the length of the frame 2.

Each trunk line has a water receiving port 16 positioned in a rear of the trunk line, which is near the rear of the boat lift frame. The rear of the boat lift frame is defined as the end of the boat life frame that is generally adjacent to the stern of a boat 30 when a boat is in position on the boat lift, as shown in the drawing figures. The water receiving port of the trunk lines is preferred to be near the rear of the boat lift, since typically, boats are heavier at the rear. While the device is designed to use multiple complimentary components to submerge and raise the frame at a relatively horizontal and level attitude, it is preferred that the water receiving ports are held under the water by the rearwardly biased weight of most vessels.

Each trunk line communicates by a flow limiting conduit 18 that connects the associated trunk line to the associated flotation tank. For example, the trunk line associated with the flotation tanks on the left side of the boat lift will have a flow limiting conduit connecting the trunk line to each of the flotation tanks, such that if there are three flotation tanks, there will be three float limiting conduits from the associated trunk line to the left side of the flotation tanks. Similarly, the trunk line on the right side will be connected by a flow limiting conduit from the trunk line to each of the three flotation tanks so that three flow limiting conduits run from the trunk line to the three flotation tanks. Further, a conduit 20 connects the first trunk line to the second trunk line.

Several elements of the invention permit the boat lift frame to be submerged while maintaining a relatively horizontal position. The use of multiple flotation tanks, each having a flow limiting conduit from a trunk line, regulates the flow of water into each of the tanks. As the valves on the rear of the trunk lines associated with the ports 16 are opened by an actuator (FIG. 10), which is preferably a pneumatic actuator housed in a sealed, water proof housing, water floods the trunk lines. If multiple flotation tanks are not used, the weight of the boat would tend to cause the rear portion of a single tank to flood at rear, preventing the boat lift from descending evenly. The use of the trunk line with the flow limiting conduit means that water is available for each of the conduits from the trunk line in a relatively even volume and relatively even flow rate, so that the plurality of flotation tanks, such as three flotation tanks, fills evenly. Further, having a conduit that communicates water from the first trunk line to the second trunk line also assures that water is available for both trunk lines, and that relatively the same volume of water is present in each of the trunk lines, so that the plurality of tanks on each side of the boat lift frame all fill at generally the same rate, keeping the boat lift at a proper attitude.

Further, mounting the boat lift frame to the floating bulkhead 22 or similar stationary mounting allows the boat lift frame to descend with a generally horizontal attitude. By hinging the hinged frame section at the front of the boat lift frame and at the floating bulkhead or similar stationary mounting, the boat lift frame descends and ascends relatively evenly.

Figure 1:
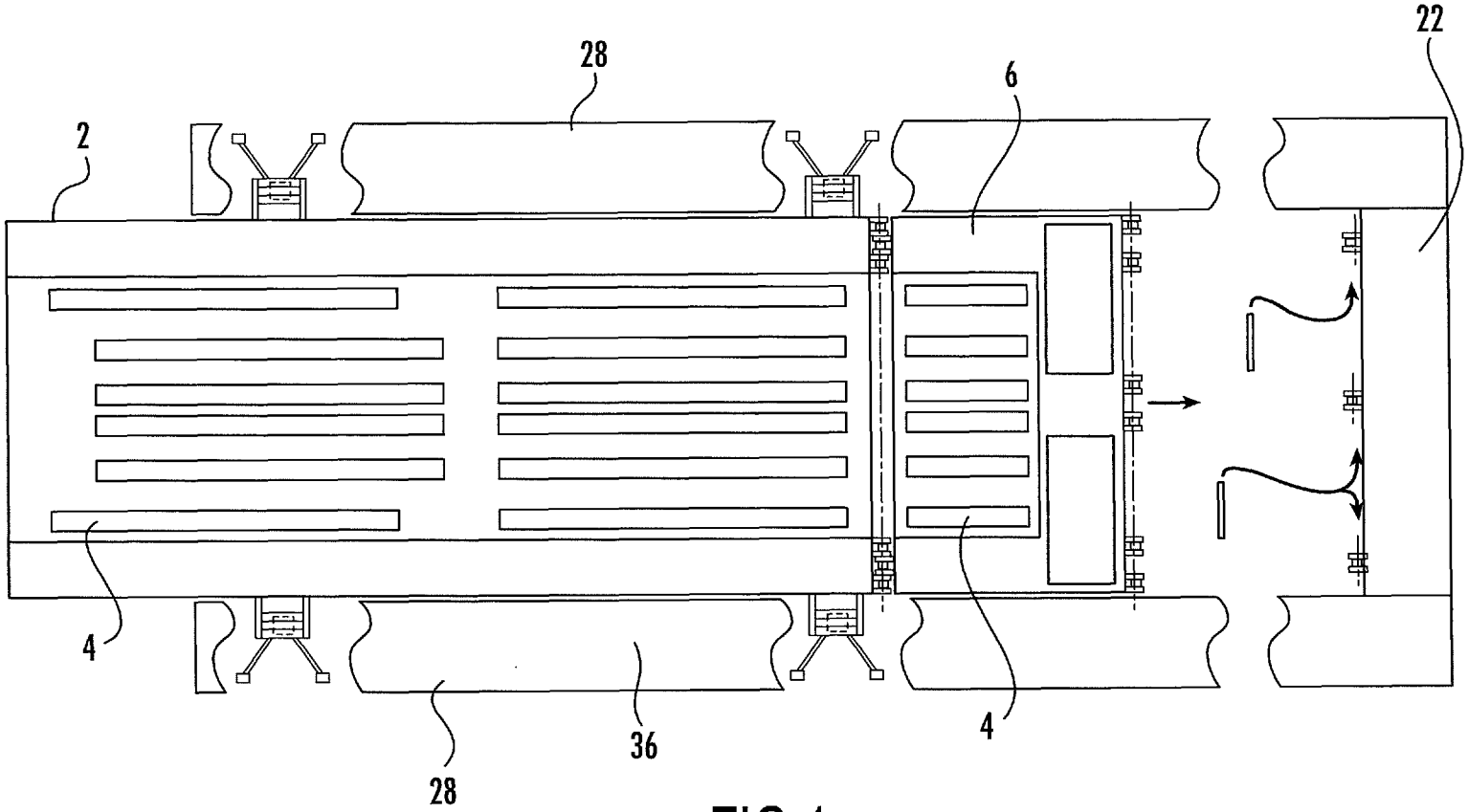
FIG. 1 is top plan view of the dock demonstrating an attachment of a hinge that attaches the hinged frame section of the lift to a floating bulkhead.
Figure 2:
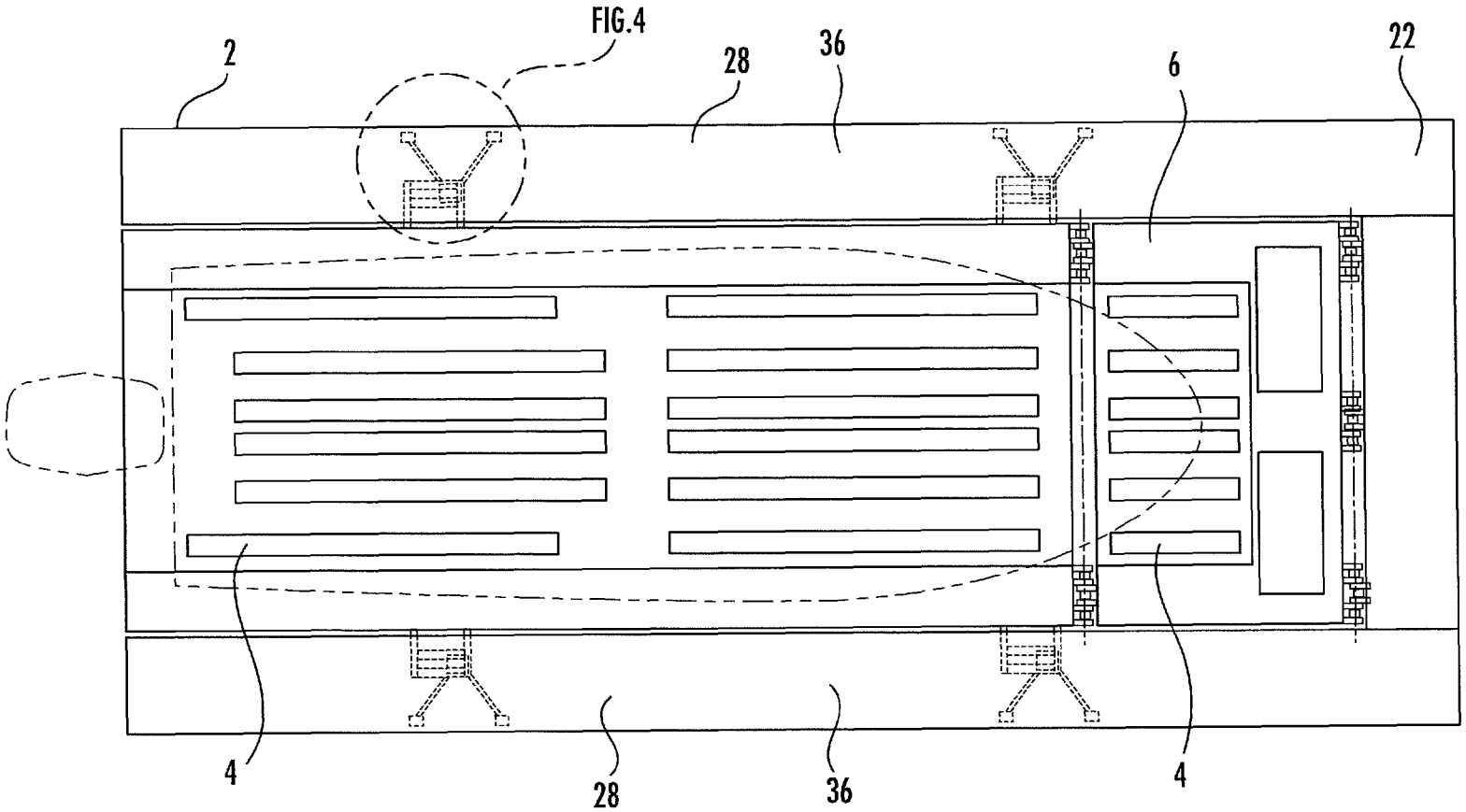
FIG. 2 is a top plan view of the dock of FIG. 1 with the dock in place and the hinged frame section attached to the floating bulkhead.
Figure 3:
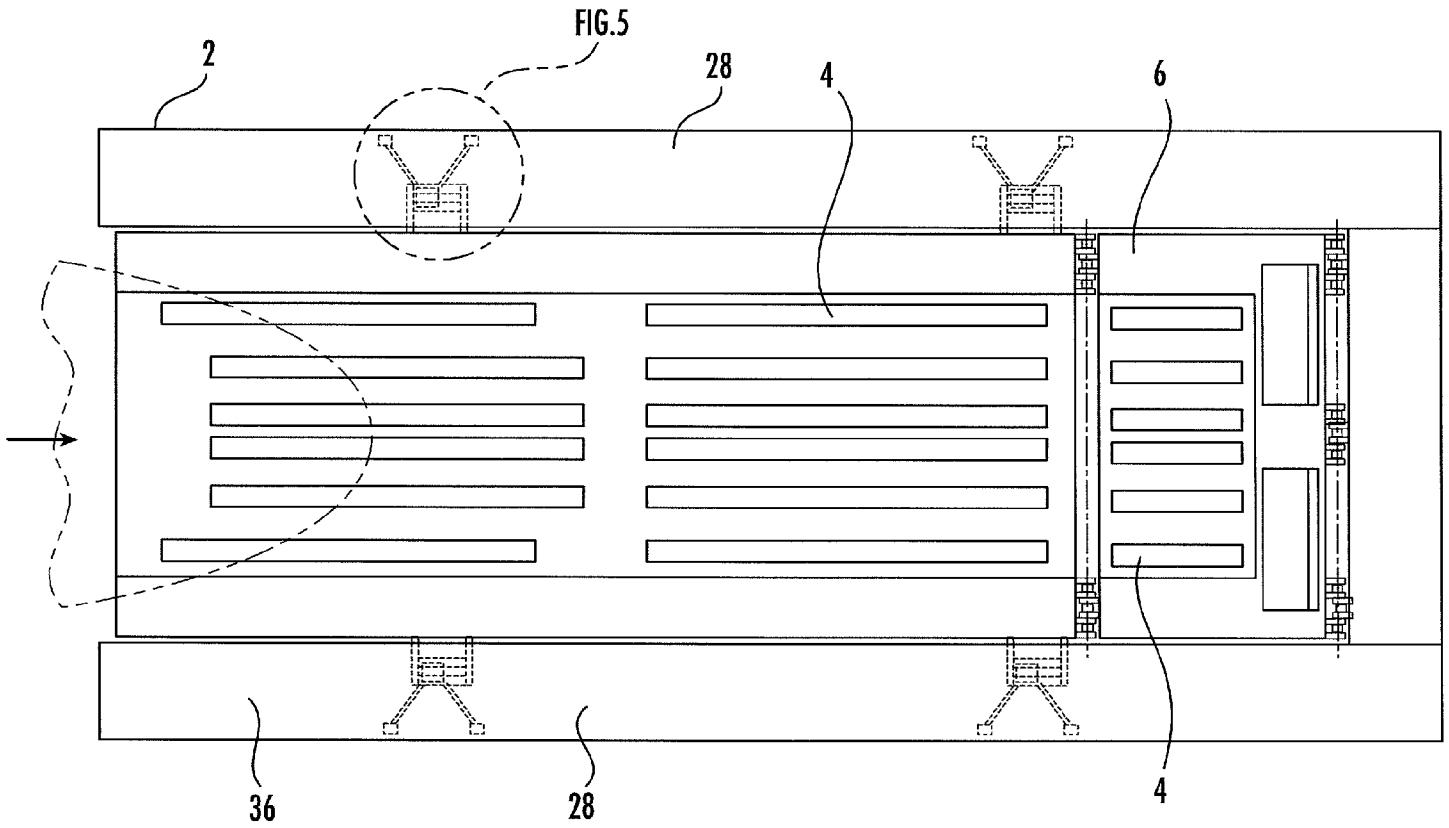
FIG. 3 is the top plan view of the dock of FIG. 2 demonstrating a boat shown in phantom lines entering the boat lift.
Figure 4:
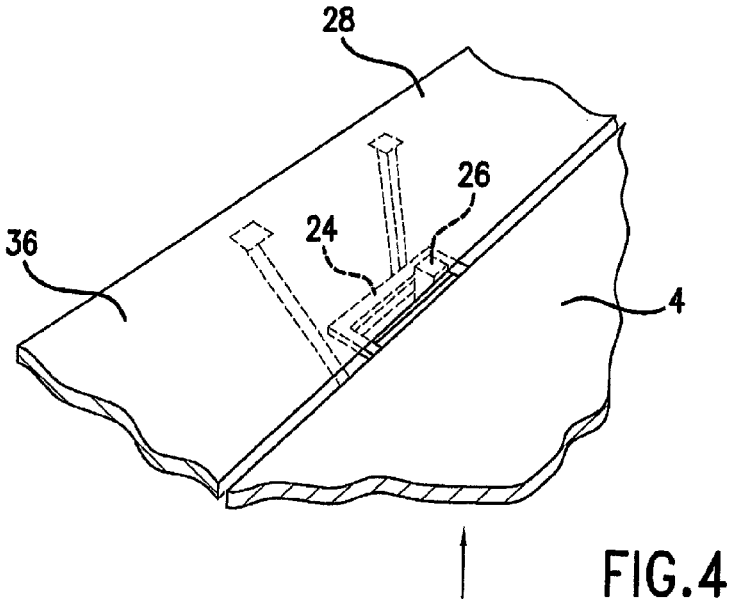
FIG. 4 is an isolation taken essentially as shown in FIG. 2, with a lateral stabilizer positioned in the boat lift frame, with the boat lift in a raised, upper position.
Figure 5:
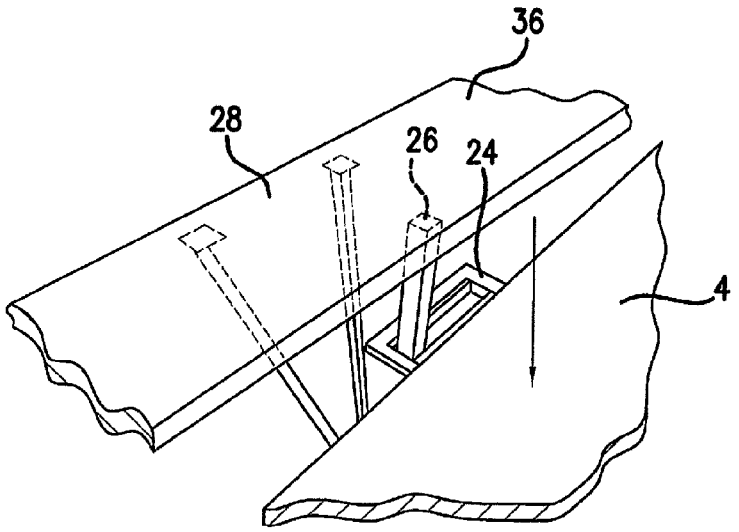
FIG. 5 is an isolation essentially taken as shown in FIG. 3, with a lateral stabilizer positioned in the boat lift frame, with the boat lift in a lowered position.

Mounting of the boat lift to the lateral stabilizers as shown in FIG. 4 is also important to the boat lift in descending and ascending at a relatively even attitude. Due to the movement of the hinged frame section 6, the boat lift frame will be moved forward as the boat lift frame descends to the position of FIG. 7, and pushed to the rear by the movement of the hinges of the hinged frame section shown in FIG. 9. At least two (2) hinges on each end of the hinged frame section is preferred. The slotted mounting brackets 24 shown in FIGS. 4 and 5 permit forward and rearward movement of the boat lift, maintaining the desired attitude. Lateral stabilizers 26 are positioned within the slotted mounting brackets to prevent movement of the boat lift at a right angle to the forward and rearward travel of the boat lift during normal operation. These slots, while permitting movement of the boat lift in one direction (such as forward and rearward), retard movement of the boat lift in other directions (such as side-to-side). The slots also prevent the boat lift from being pushed to an undesired attitude by wave action striking the side of the boat lift. The lateral stabilizers in a preferred embodiment are also used as mounting for the catwalk 28, which may run the length of the boat life frame on one or both sides of the dock. In a preferred embodiment, the floating dock is "free standing" except for the engagement of the slotted mounted brackets 24 with the lateral stabilizers 26.

The preferred catwalks 28 are supported by flotation tanks 32. The flotation tanks are water tight, but provide a water inlet and/or outlet for filling the tanks or withdrawing water from the tanks. During construction and/or positioning of the dock, catwalks are positioned alongside the boat lift frame. The flotation tanks are filled with water 34 to a level of the flotation tanks that holds the catwalk in the desired position relative to the boat lift frame, so that the top decking 36 of the catwalks, which may be covered similarly or identically to the boat lift frame, are at the desired position relative to the decking of the boat lift frame. Once the water level in the flotation tanks of the catwalks is sufficient to hold the catwalk in the desired position, it should not be necessary to frequently adjust the flotation tanks' water level. In a preferred embodiment, when the boat lift frame has lifted the boat to the full upper position, so that the hull of the boat is out of the water, the decking of the boat lift frame, where it joins the catwalk, and the decking of the catwalk will be relatively even each with the other. Occupants of the boat may ingress and egress the boat by traversing the catwalk or the hinged frame section, without the decking of any of these elements presenting a tripping hazard.

Figure 7:
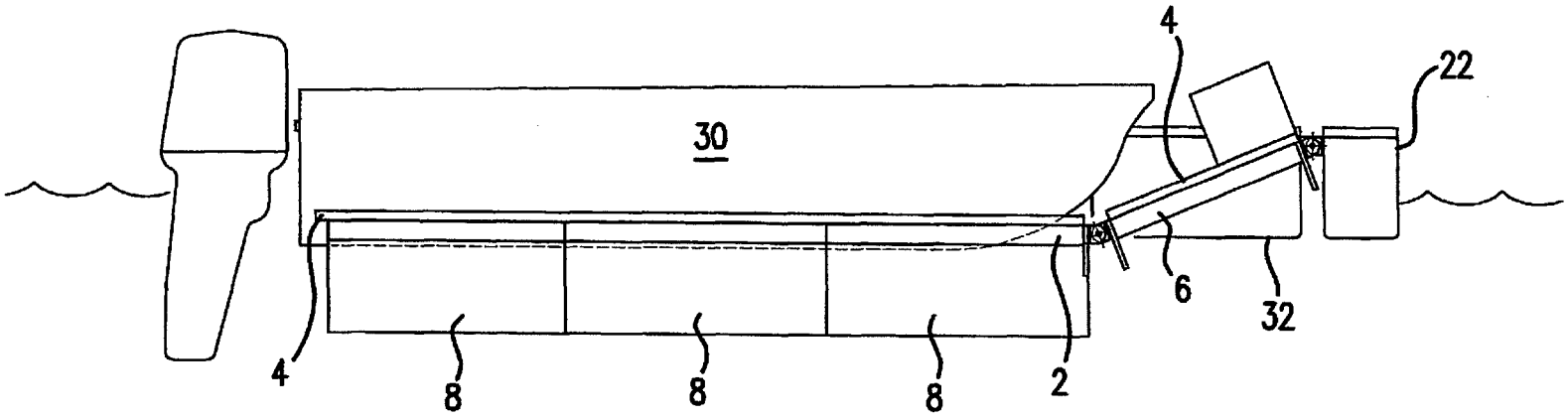
FIG. 7 is a side elevation of the boat lift and boat of FIG. 6.
Figure 9:
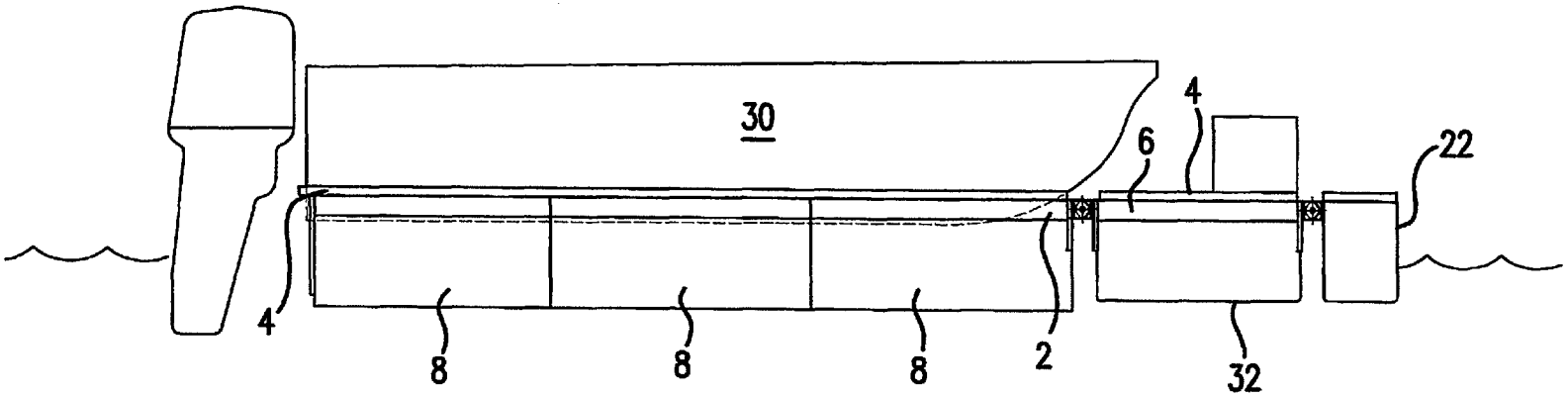
FIG. 9 is a side elevation of the boat lift and boat of FIG. 8.

In a preferred embodiment, the floating bulkhead, the catwalks 28, bulkhead 22, frame 2, planking 4, and hinged frame section 6 are connected as shown in the drawing Figures and the entire assembly is floating. FIG. 7; FIG. 9 The construct is held in position relative to the body of water in which it floats by the brackets 24 and the stabilizers 26. The hinged construction allows the catwalks, the frame in which the boat is positioned, and the floating bulkhead to each be positioned with the top surface each at a different level, which is a level that is most suitable for each component, even though each of these components is floating and interconnected. The catwalks may be caused to float by regulating a water level in associated tanks as described herein. The floating bulkhead is floating due to its own floatation (as used with the catwalks being positioned under the bulkhead) and due to being connected to the catwalks and the boat lift, and the floating height adjusted by the water level in the tanks, as described with the catwalks. Additional flotation may be provided by the use of tanks like tanks 32 positioned under the hinged frame section 6.

Figure 10:
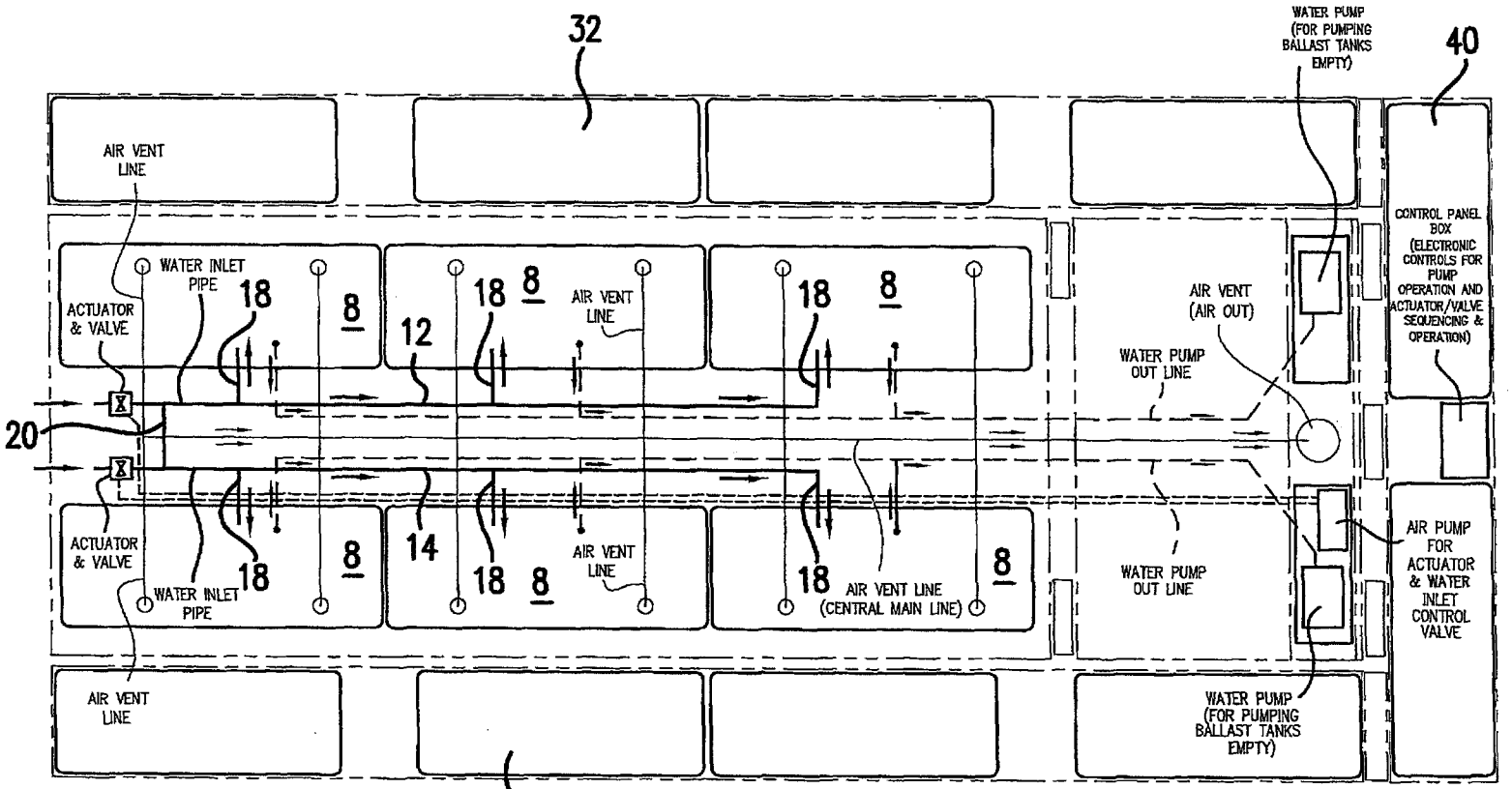
FIG. 10 is a schematic demonstrating operational air and water flow for the boat lift.

A preferred schematic of the operational elements is shown in FIG. 10. The left side of the schematic represents the rear of the boat lift. Arrows demonstrate water entering the water receiving ports 16 of the preferred parallel trunk lines. A valve is associated with each water receiving port, and the valve may be fully or partially opened, and fully or partially closed, as desired, to allow water to flood the trunk lines. As further demonstrated by arrows between the trunk lines and the flotation tanks, water flows through the flow limiting conduits to the flotation tanks 8. A conduit also permits flow between each of the trunk lines. Air vents are provided in an upper portion of each of the flotation tanks as shown, to allow air to evacuate the flotation tanks as water floods the flotation tanks. Air vent lines connect the air vents in this embodiment.

The force of gravity holds the openings of the trunk lines under water, with the water entering the flotation tanks with the valves of the trunk lines open. The valves are controlled by one or more actuators. The actuator(s) are preferred to be pneumatically controlled with an air compressor providing air pressure for actuating the valve by means of the actuator. Operation of the valves, and therefore filling of the flotation tanks, may further be controlled by a timer, or by a water level sensor. When the flotation tanks are filled with water, the boat lift frame, and any associated boat or vessel, is submerged to a depth that allows the boat to float in water, and be driven on or off of the boat lift frame and the decking thereof. In one embodiment, only one inlet, valve and actuator is used to allow water to float into flotation tanks.

An air vent communicates with the air vent lines as shown in the schematic. In a preferred embodiment, the air vent is positioned near the front of a boat lift as shown in FIG. 10. The air vent has a valve associated with it, and the valve may also have an actuator that operates the valve to a fully opened or fully closed or partially open or partially closed position. The actuator may be pneumatically operated and controlled. By controlling the rate of flow of air out of the air vent, the rate of submersion of the boat lift can be controlled. In a preferred embodiment, the openings of the trunk lines and water flow from the trunk lines into the flotation tank are sufficient to allow the boat lift to travel from fully raised to fully submerge in less than one minute. However, by limiting the degree of opening of the air vent, and thereby limiting the rate of flow of air out of the flotation tanks, the rate of water entering the flotation tanks, and therefore the rate of submersion, may also be controlled.

The boat lift is raised by evacuating water from the flotation tanks and replacing the water with air. In a preferred embodiment, evacuation of the water is performed by pumping the water from the flotation tanks, using one or more water pumps. To accomplish water evacuation from the flotation tanks, the ports of the trunk lines at the rear of the boat lift are closed by the actuators. Water is then pumped from the flotation tanks and trunk lines and out of the device through water pump out lines that communicate with each of the flotation tanks.

During the water evacuation process, the air vent will remain open so that air replaces water that is evacuated. The water flow rate may be regulated by partially closing the air vents. However, in most cases, the air vent will remain fully open, since rapid evacuation of water, and the associated lifting action, is desired to occur relatively rapidly. Sensors may be provided so that when there is no water flow to the water pumps, or an individual pump of a plurality of water pumps, operation of the pump or pumps is terminated.

In a preferred embodiment, a central control panel 40 for operating the boat lift is provided. The control panel may have a simple command selector to raise or lower the boat lift. Other controls may control the rate of flow of water and/or air in and out of the flotation tanks by operation of the valves as discussed herein. In other embodiments, manual controls for actuating the pumps or terminating operations of the pumps may be provided.

In some embodiments, the boat lift frame is built in a plurality of sections, with one flotation tank positioned on each side of the modular section. The sections of the frame may be attached with fasteners that are removable, such as nuts and bolts, rather than welding the entire length of the frame together. In this manner, a modular boat lift that may be built to a customized length by adding or removing sections is available. As shown in the drawings, three frame sections are connected, with each frame section comprising an associated flotation tank. More, or fewer, sections could be used to vary the length of the boat lift.

Figure 11:
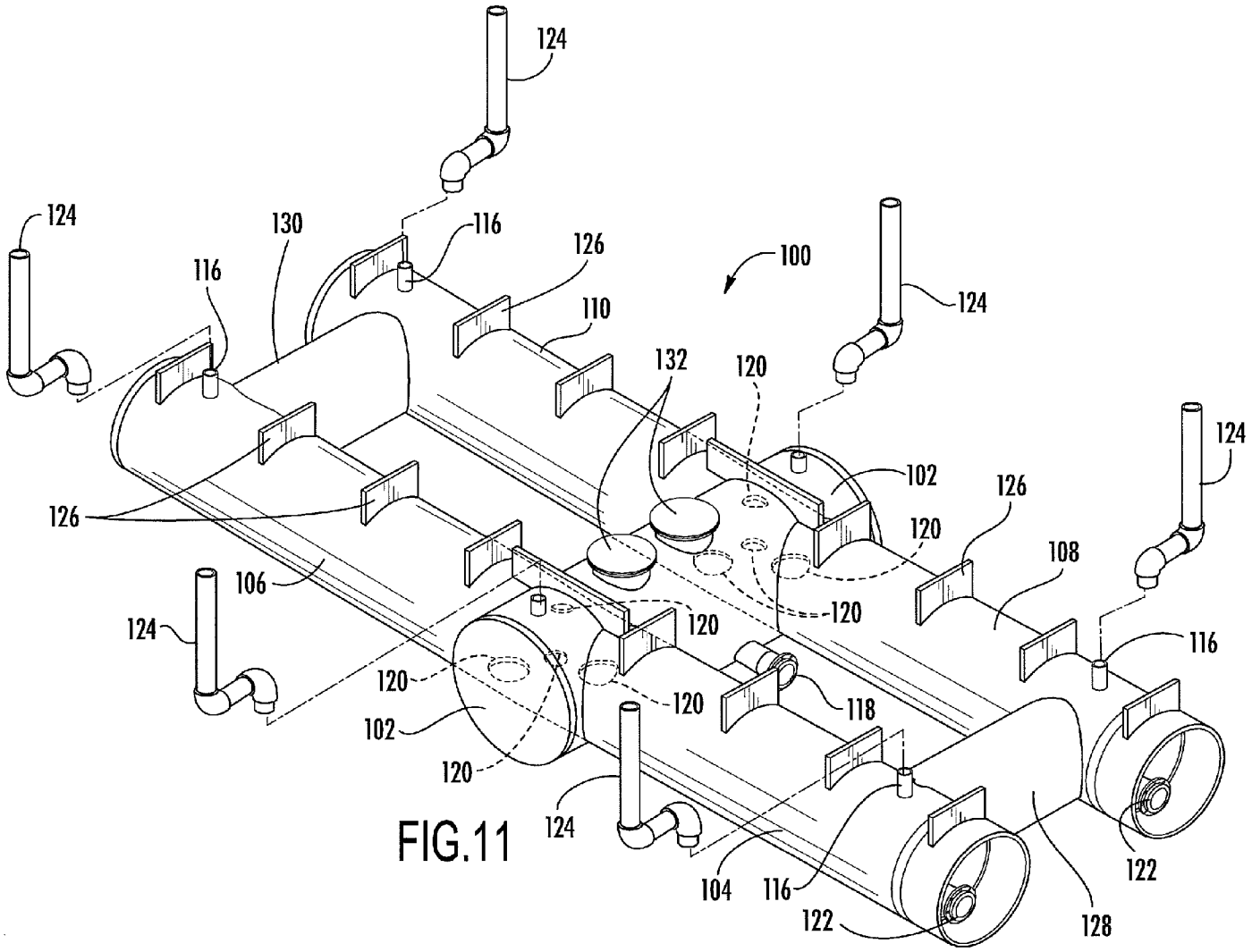
FIG. 11 is perspective view of another embodiment of flotation elements for the frame of the boat lift.

FIG. 11 shows another construct 100 that provides selective flotation of the boat lift frame. In this embodiment, the construct comprises five flotation tanks that are joined together and which are in hydraulic communication with each other, that is, water flows between the tanks.

The embodiment of FIG. 11 shows a transverse tank 102 that is positioned at or near the center of the construct. Four flotation tanks are connected to the transverse flotation tank, and may be designated as first flotation tank 104, second flotation tank 106, third flotation tank 108 and fourth flotation tank 110. In this example, the first flotation tank is connected at one end to the transverse flotation tank. The second flotation tank is connected at an end to the transverse flotation tank, and opposite the side of the transverse flotation tank to which the first flotation tank is connected. The third flotation tank is connected at an end to the transverse flotation tank. The fourth flotation tank is connected to the transverse flotation tank and opposite the side of the transverse flotation tank to which the third flotation tank is connected.

The resulting construct is one in which the first and second flotation tanks are positioned generally parallel to the third and fourth flotation tanks. Each of the first flotation tank, second flotation tank, third flotation tank, fourth flotation tank are generally perpendicular to the transverse flotation tank as shown.

Pumps are used to pump water out of the flotation tanks. The water is replaced with air, which causes the flotation tank construct to float. Water is pumped from the flotation tank construct and replaced with air, so that the boat lift frame floats at the desired level.

Figure 12:
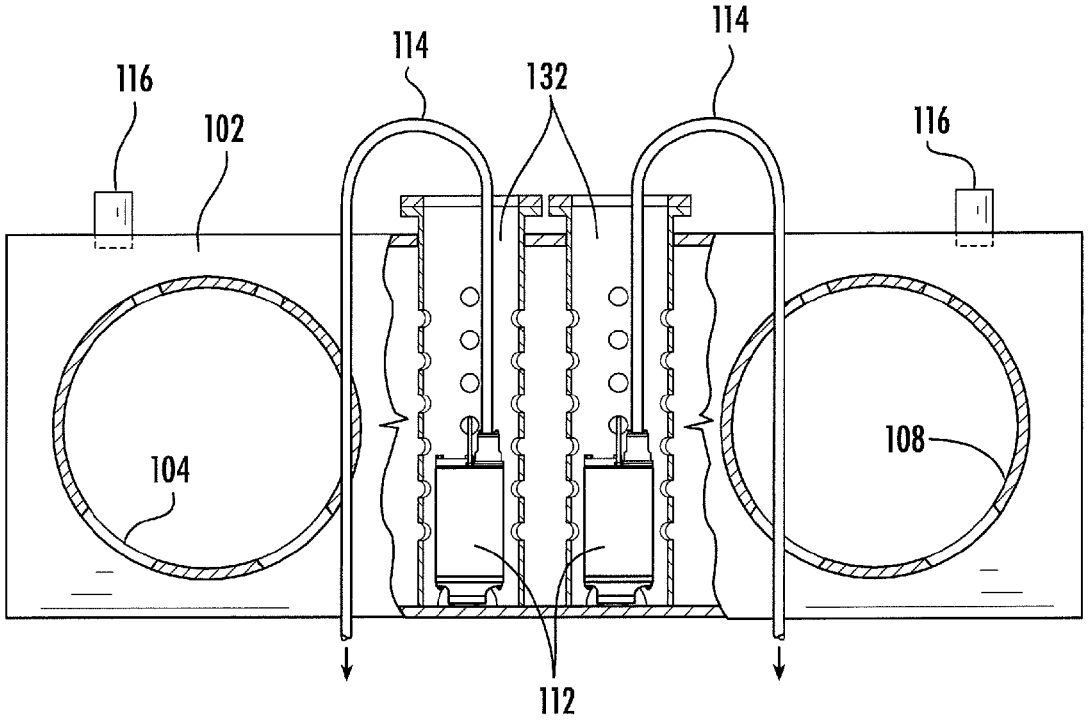
FIG. 12 is an elevation of the flotation elements of FIG. 11, cut away to show pumps in a transverse flotation tank.

In a preferred embodiment, submersible pumps 112 are positioned within the transverse flotation tank. FIG. 12. Each pump may be inserted into a pump sleeve 132 that houses each pump. The pump sleeves may be formed of high density polyethylene pipe that is perforated to allow adequate water flow intake and exhaust. The submersible pumps are positioned at or near a center of the transverse flotation tank so as to balance the flotation tank construct, and also to remove water relatively uniformly from the flotation tank construct, thereby maintaining balance during the process of pumping water from the flotation tank construct. The submersible pumps may be submersible pumps such as those manufactured by Gorman-Rupp.

Water is pumped by the pumps through one or more outlets 114, which are preferred to open below the flotation tank construct and, therefore, below the water line. Air vents 116 that communicate with the flotation tanks cause air to enter the flotation tanks as water is pumped from the flotation tank construct.

Water receiving inlets 118 communicate with the flotation tank construct. In a preferred embodiment, the water receiving inlet or inlets are positioned near the center of the flotation tank construct, and more preferably, are positioned to communicate directly with the transverse flotation tank 102. By positioning the water receiving inlets in this embodiment near the center of the flotation tank construct, such as near the generally centralized transverse flotation tank, water enters the flotation tank construct near the center thereof, balancing the boat lift frame as it fills with water. The water receiving inlets may have relatively short trunk lines so as to not position the opening or openings to the inlets far from the center of the flotation tank construct.

Opening and closing the water receiving inlets is preferred to be formed by a valve for each inlet. The valve is remote controlled and may be electrically actuated. The valves and electric actuator may be those such as those manufactured by Rotork.

In the preferred embodiment, the transverse flotation tank, first flotation tank, second flotation tank, third flotation tank and fourth flotation tank may be constructed of high density polyethylene (HDPE) and may be formed of HDPE pipe. The first flotation tank, second flotation tank, third flotation tank, and fourth flotation tank may be mounted to the transverse flotation tank as shown in the drawings by welding methods for HDPE that are known.

When the flotation tanks are welded to the transverse flotation tank about the perimeter of the ends, as shown in the drawing Figures, water communication passages 120 are formed between the transverse flotation tank and the other flotation tanks so that there is hydraulic communication between all tanks. These passages should formed on lower portions of the flotation tanks to insure draining, and be of sufficient size to allow for rapid evacuation of water from the flotation tanks.

It is preferred that the first flotation tank, second flotation tank, third flotation tank and fourth flotation tank incline away from the transverse flotation tank (FIG. 14, FIG. 16) so that water flows from the ends of the flotation tanks toward the transverse flotation tank due to gravitational pull. In one embodiment, the first flotation tank, second flotation tank, third flotation tank, and fourth flotation tank are inclined away from the transverse flotation tank at an angle of 2 degrees to 5 degrees from horizontal, particularly along the bottom portion of these flotation tanks.

A flotation construct as described above may be mounted under the frame and/or deck of the embodiment of the boat lift shown in FIGS. 6-9. See, in particular, FIGS. 13-16. Mounting tabs 126 may be used to mount the flotation tank construct to the frame 2.

Optionally, or additionally, water receiving inlets 122 may be positioned near an end of the second flotation tank and fourth flotation tank that are opposite the ends thereof mounted to the transverse flotation tank. Positioning water receiving inlets at the end of these flotation tanks may be preferred where water is shallow and the bottom of the body of the water slopes upwardly from the rear of the boat lift toward the front of the boat lift. The water receiving inlets 122 may have electrically actuated valves.

Structural members may be provided. In the embodiment shown, transverse members 128, 130 are positioned opposite the transverse flotation tank 102. These members may be hollow to provide additional flotation, and may or may not hydraulically communicate with the adjoining tanks.

Figure 13:
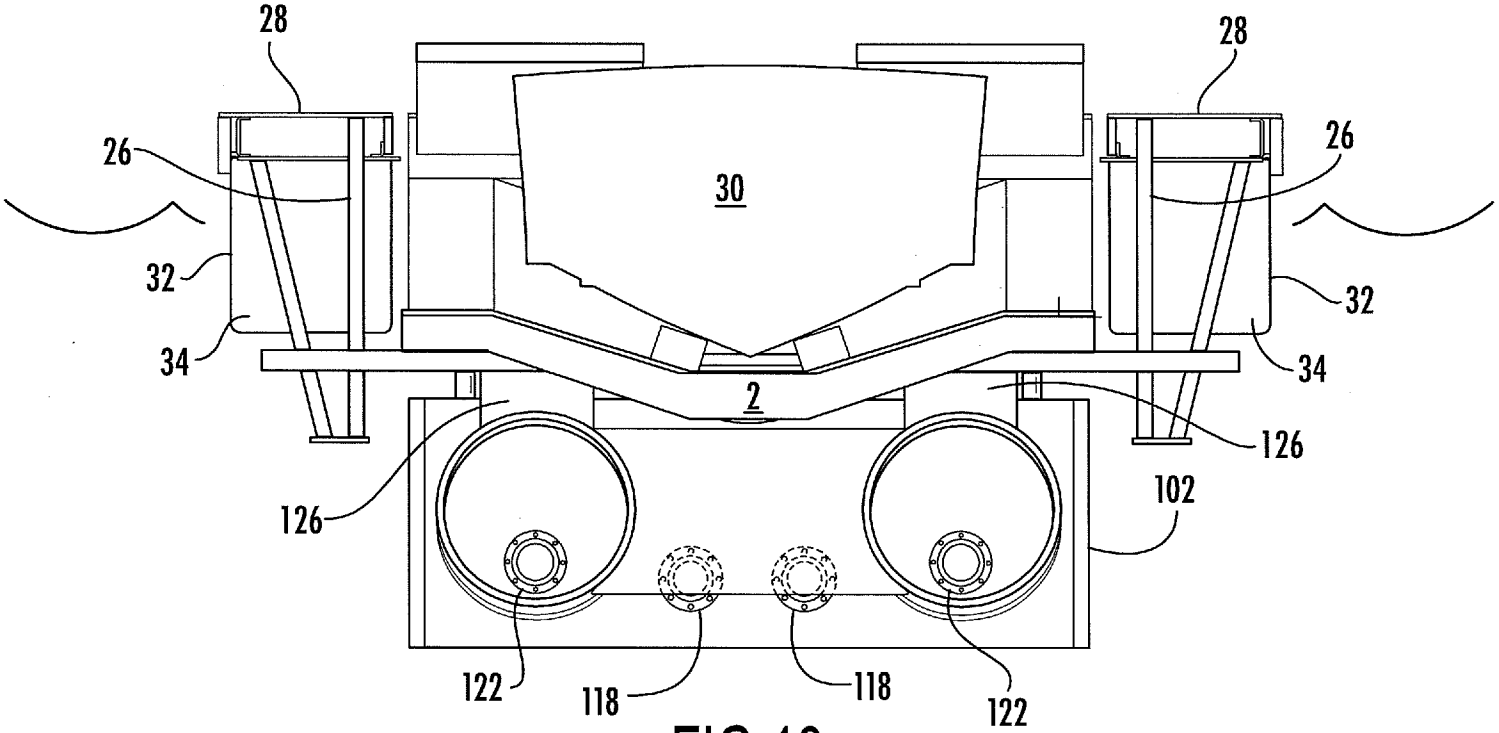
FIG. 13 shows a rear elevation of the flotation elements of FIG. 11 mounted under the boat frame with the boat lift partially submersed.

In use, the flotation construct is partially or completely filled with water so that the frame of the boat is below the water line. FIG. 13. Please note that the catwalk and bulkhead is shown to float at a relatively constant height since the flotation tanks where the catwalks and the bulkhead are independent of the flotation construct of FIG. 11.

Figure 14:
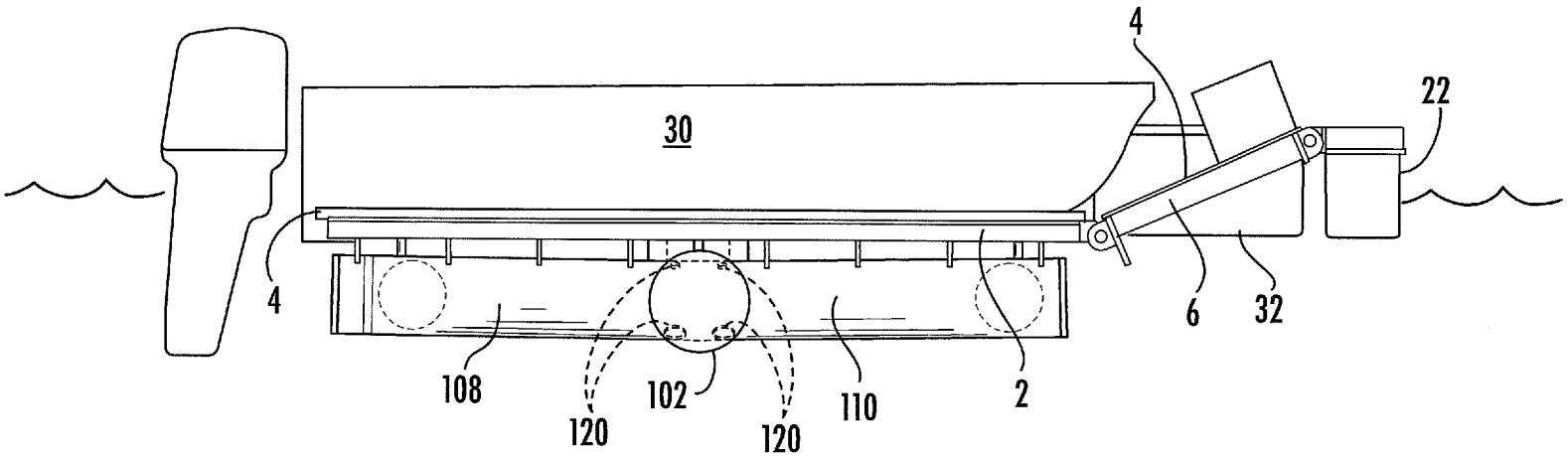
FIG. 14 shows a side elevation of the flotation elements of FIG. 11 mounted under the boat frame with the boat lift partially submersed.

In the position shown in FIG. 13 with the frame 2 and deck submerged, a boat may be driven or otherwise positioned onto the deck of the boat lift frame. After the boat is secured in position on the frame, such as shown in FIG. 14, the water receiving inlets are closed, such as by actuation of the valves. The submersible pumps are actuated, and water is pumped from the flotation tank construct. FIG. 12. Air enters the flotation tank construct through the air vents 116 to replace the water. The vents preferably have conduits 124 to ensure that the openings of the air vents are above the water line when the boat lift frame is submersed.

Figure 15:
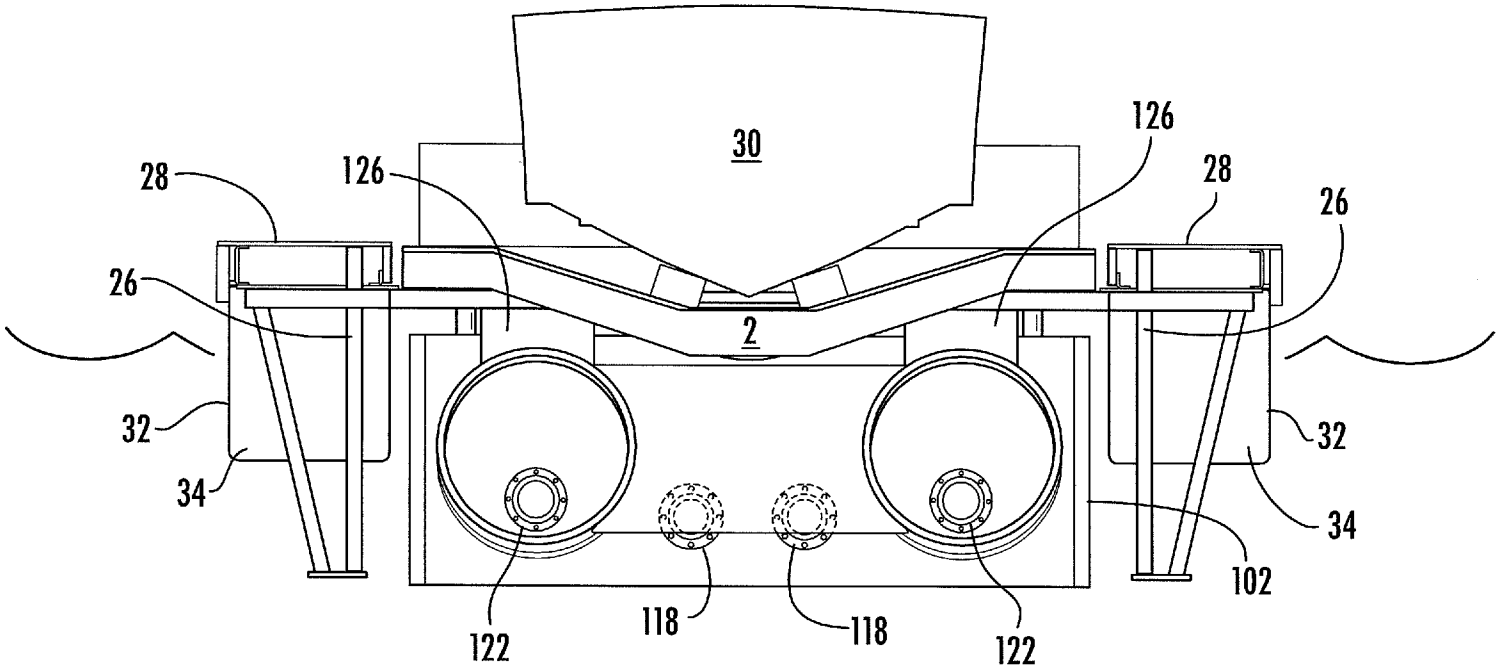
FIG. 15 shows the rear elevation of the flotation elements of FIG. 11 mounted under the boat frame with the boat lift floating.
Figure 16:
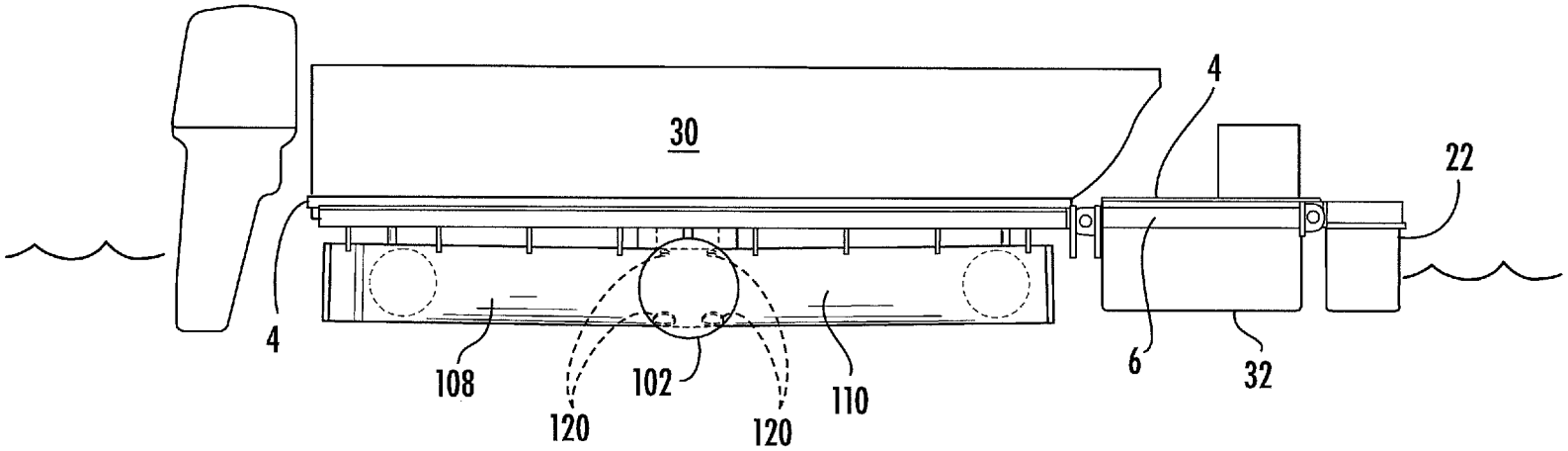
FIG. 16 shows the side elevation of the flotation elements of FIG. 11 mounted under the boat frame with the boat lift floating.
Figure 17:
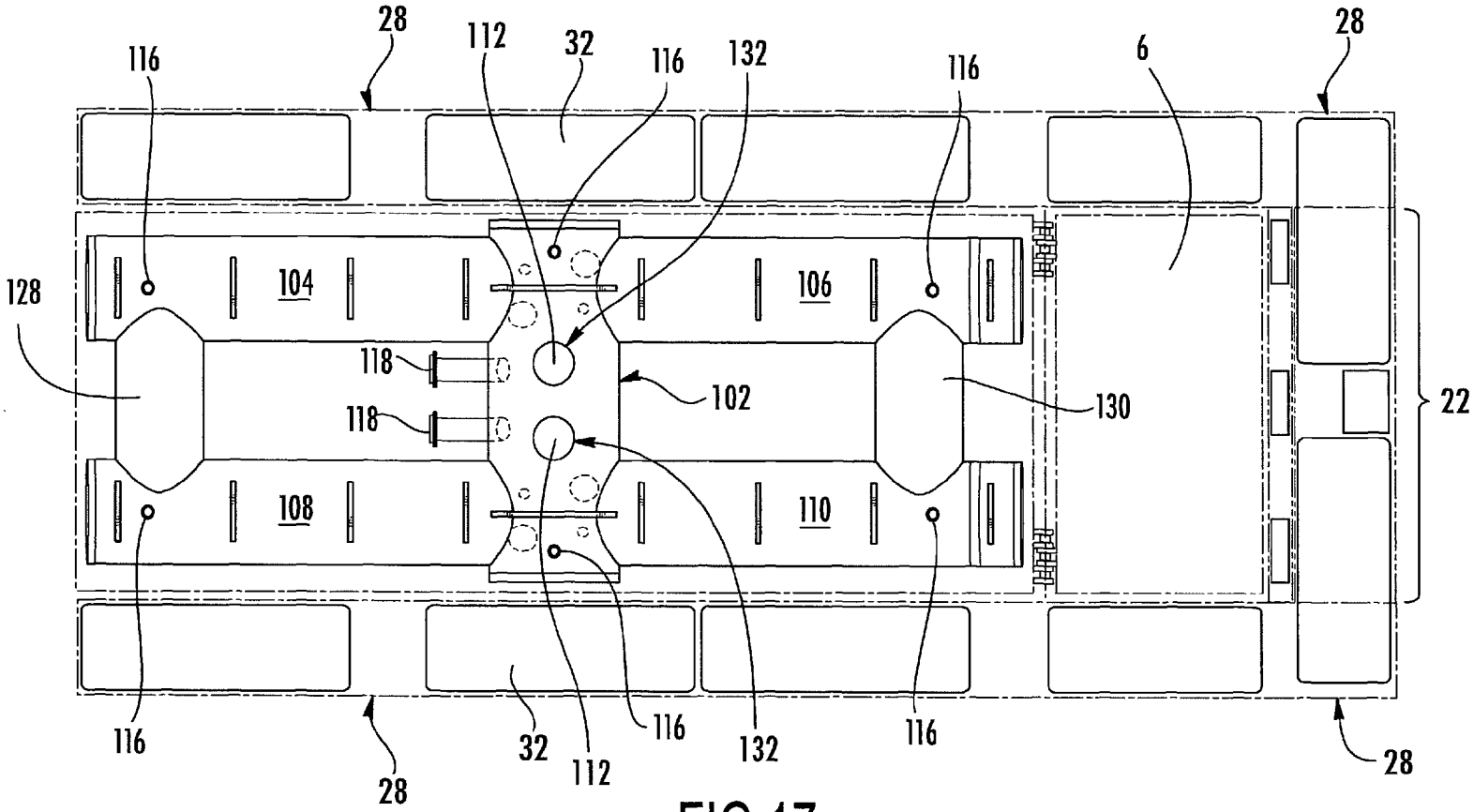
FIG. 17 is a top plan view of the flotation elements of FIG. 11, with flotation elements for catwalks and bulkhead.

As water is expelled from the flotation tank construct and air enters the flotation tank construct, the lift frame floats. The submersible pumps are actuated until the boat lift frame reaches the desired level, which is typically after the bottom of the boat is completely above the water line, and the boat is at a level that makes entering and exiting the boat by means of the catwalks convenient. FIG. 15, FIG. 16.

The boat may subsequently be lowered for use by opening the valves to the water receiving inlets 118 and allowing water to enter the flotation tank construct. The boat lift frame and the boat are submersed sufficiently to allow the boat to float above the boat lift frame sufficiently to allow the boat to exit the boat lift frame. In one embodiment, submersible pumps are used that can reverse the flow of water so as to pump water into the flotation tank construct to flood the flotation tank construct.

The floating boat lift according to the invention is a closed system when the flotation tanks are not taking on water or expelling water as described herein. This structure is contrasted with other boat lifts and docks that have holes in the bottom of tanks that remain open at all times, with water flow regulated by air pressure within the tanks. Such holes or inlets are subject to fouling, particularly in salt water environments.

What is claimed:

1. A boat lift, comprising:

a boat lift frame constructed and arranged to receive a boat hull on an upper surface thereof, the boat lift frame comprising;

a transverse flotation tank positioned under a first side of the boat lift frame;

a first flotation tank that joins the transverse flotation tank at an end of the first flotation tank;

a second flotation tank that joins the transverse floatation tank at an end of the second flotation tank and opposite the first flotation tank;

a third flotation tank that joins the transverse floatation tank at an end of the third flotation tank; and a fourth flotation tank that joins the transverse floatation tank at an end of the fourth flotation tank and opposite the third flotation tank;

wherein the first flotation tank is spaced apart from and is generally parallel with the third flotation tank;

the transverse flotation tank being in hydraulic communication with the first flotation tank, the second flotation tank, the third flotation tank and the fourth flotation tank.

2. A boat lift as described in claim 1, wherein each of the first flotation tank, the second flotation tank, the third flotation tank and the fourth flotation tank are disposed at an incline away from the transverse flotation tank.

3. A boat lift as described in claim 1, wherein the transverse flotation tank comprises a pump having a water outlet, wherein the water outlet communicates with an exterior of the transverse flotation tank.

4. A boat lift as described in claim 1, wherein the transverse flotation tank comprises:

a water receiving inlet that communicates with an exterior of the transverse flotation tank; and a pump having a water outlet;

wherein, in use, water received in the transverse flotation tank, the first flotation tank, the second flotation tank, the third flotation tank and the fourth flotation tank from the water inlet is expelled from the transverse flotation tank, the first flotation tank, the second flotation tank, the third flotation tank and the fourth flotation tank by the pump and through the water outlet.

5. A boat lift as described in claim 1, further comprising a bulkhead and a hinged frame section, wherein the hinged frame section is hingably connected to the boat lift frame and hingably connected to the bulkhead.

6. A boat lift as described in claim 1, further comprising:

a plurality of stabilizer arms;

the boat lift frame comprising brackets for receiving the plurality of stabilizer arms, wherein the stabilizer arms and brackets are constructed and arranged to permit movement of the boat lift frame in a direction dictated by movement of a hinged frame section that is hingably connected to the boat lift frame and to retard movement of the boat lift frame in other directions.

7. A boat lift as described in claim 1, further comprising a bulkhead and a hinged frame section, wherein the hinged frame section is hingably connected to the boat lift frame and hingably connected to the bulkhead, and wherein, in use the boat lift frame, the hinged frame and the bulkhead float within a body of water.

8. A boat lift as described in claim 1, further comprising a catwalk positioned along a length of the boat lift frame, the catwalk connected at one end to a bulkhead.

9. A boat lift as described in claim 1, wherein a first stabilizer arm is positioned to an outside of the boat lift frame, and a second stabilizer arm is positioned on the outside of the boat lift frame, the boat lift frame having a first bracket comprising a slot for receiving the first stabilizer arm therein and having a second bracket comprising a slot for receiving the second stabilizer arm therein.

10. A boat lift as described in claim 1, wherein a catwalk that is positioned along a length of the boat lift frame comprises a tank for receiving water therein, the tank comprising a water inlet and a water outlet for regulating a water level in the tank and thereby regulating a flotation height of the catwalk.

11. A boat lift as described in claim 4, wherein the water receiving inlet comprises a valve that regulates opening and closing of the water receiving inlet.

12. A boat lift as described in claim 1, wherein a first stabilizer arm is positioned to an outside of the boat lift frame, and a second stabilizer arm is positioned on the outside of the boat lift frame, the boat lift frame having a first bracket comprising a slot for receiving the first stabilizer arm therein and having a second bracket comprising a slot for receiving the second stabilizer arm therein, wherein the first stabilizer arm and slot and the second stabilizer arm and slot limit travel of the boat lift frame while permitting the boat lift frame to float within a body of water.

13. A boat lift as described in claim 1, further comprising a catwalk and a bulkhead, wherein the catwalk and the bulkhead each comprise a flotation device and wherein the flotation device for the catwalk, and the flotation device the bulkhead are constructed and arranged to provide an adjustable flotation height for the catwalk and for the bulkhead that is independent of flotation of the boat lift frame.

14. A boat lift as described in claim 4, wherein the water receiving inlet opens near a rear of the transverse flotation tank and opposite a bulkhead that is connected to the boat lift frame, the water receiving inlet comprising a valve.

15. A boat lift as described in claim 1, further comprising a transverse member that is connected at one end to the first flotation tank and is connected at an opposite end to the third flotation tank.

* * * * *